US006120133A

United States Patent [19]

Ahn

[11] Patent Number: 6,120,133

[45] Date of Patent: Sep. 19, 2000

[54] MAGNETIC INK JETTING APPARATUS

[75] Inventor: Byung-Sun Ahn, Kyungki-do, Rep. of Korea

[73] Assignee: SamSung Electronics Co., Ltd., Suwon, Rep. of Korea

[21] Appl. No.: 09/018,528

[22] Filed: Feb. 4, 1998

[30] Foreign Application Priority Data

Feb. 5, 1997 [KR] Rep. of Korea ..... 97-3447

[51] Int. Cl.[7] ..... B41J 2/14; B41J 2/16

[52] U.S. Cl. ..... 347/53

[58] Field of Search ..... 347/53, 67

[56] References Cited

U.S. PATENT DOCUMENTS

| | | | |
|---|---|---|---|
| 4,027,308 | 5/1977 | Fan et al. . | |
| 4,045,770 | 8/1977 | Arnold et al. . | |
| 4,057,807 | 11/1977 | Fischbeck et al. . | |
| 4,068,240 | 1/1978 | Fan et al. . | |
| 4,078,238 | 3/1978 | Lee . | |
| 4,196,437 | 4/1980 | Hertz . | |
| 4,227,200 | 10/1980 | Mansukhani . | |
| 4,280,130 | 7/1981 | Slemmons . | |
| 4,544,933 | 10/1985 | Heinzl . | |
| 4,620,195 | 10/1986 | Eblen et al. . | |
| 4,633,267 | 12/1986 | Meinhof . | |
| 4,721,968 | 1/1988 | Arai et al. | 346/136 |
| 4,803,501 | 2/1989 | Mielke . | |
| 4,845,517 | 7/1989 | Temple et al. . | |
| 4,968,992 | 11/1990 | Komuro . | |
| 5,187,500 | 2/1993 | Bohorquez et al. . | |
| 5,198,834 | 3/1993 | Childers et al. . | |
| 5,235,350 | 8/1993 | Lin et al. . | |
| 5,243,363 | 9/1993 | Koizumi et al. . | |
| 5,278,584 | 1/1994 | Keefe et al. . | |
| 5,350,446 | 9/1994 | Lin et al. . | |
| 5,351,375 | 10/1994 | Ochiai et al. . | |
| 5,440,333 | 8/1995 | Sykora et al. . | |
| 5,448,273 | 9/1995 | Klein et al. . | |
| 5,450,109 | 9/1995 | Hock . | |
| 5,451,987 | 9/1995 | Perrin . | |
| 5,491,505 | 2/1996 | Suzuki et al. . | |
| 5,557,308 | 9/1996 | Chandrasekaran . | |
| 5,559,543 | 9/1996 | Komuro . | |
| 5,570,119 | 10/1996 | Saito et al. . | |
| 5,639,508 | 6/1997 | Okawa et al. . | |
| 5,649,346 | 7/1997 | Katsuumi et al. . | |
| 5,650,802 | 7/1997 | Suzuki et al. . | |
| 5,677,717 | 10/1997 | Ohashi . | |

FOREIGN PATENT DOCUMENTS

| | | | |
|---|---|---|---|
| 363302056 | 12/1988 | Japan | 347/53 |
| 363302057 | 12/1988 | Japan | 347/53 |
| 401157862 | 6/1989 | Japan | 347/53 |
| 403132354 | 6/1991 | Japan | 347/53 |
| 405169663 | 7/1993 | Japan | 347/53 |

OTHER PUBLICATIONS

Ohashi '717 discloses an ink ejecting device having a multi–layer protective film for electrode.

Suzuki et al. '802 discloses an ink despersion device for liquid droplet ejecting apparatus.

Katsuumi et al. '346 discloses a manufacturing method for ink jet printer head.

Okawa et al. '508 a method for producing a layered piezo-electric element.

Saito et al. '119 discloses a multilayer device having integral functional element for use with.

*Primary Examiner*—N. Le
*Assistant Examiner*—Michael S Brooke
*Attorney, Agent, or Firm*—Robert E. Bushnell, Esq.

[57] ABSTRACT

There is provided a magnetic ink jetting apparatus which, when magnetic ink is jetted from an ink jet apparatus, uniformly mixes the pigment and liquid of the magnetic ink and jets it. The magnetic ink jetting apparatus for jetting the magnetic ink with a uniform mixture of pigment and liquid includes a plurality of ink chamber barriers forming an ink chamber for receiving the magnetic ink, and a magnetic layer creating magnetism in the ink chamber so as to concentrate the pigment of the magnetic ink, the magnetic layer being formed between the plurality of ink chamber barriers.

28 Claims, 4 Drawing Sheets

MAGNETIC INK JETTING APPARATUS

This application makes reference to, incorporates the same herein, and claims all benefits accruing under 35 U.S.C. § 119 from my application Entitled *Magnetic Ink Jetting Apparatus* earlier filed in the Korean Industrial Property Office on the 5th day of Feb. 1997, and there duly assigned Ser. No. 97-3447 by that office.

BACKGROUND OF THE INVENTION

1. Technical Field

The present invention relates to a magnetic ink jetting apparatus, and more specifically to a magnetic ink jetting apparatus which uniformly mixes the pigment and liquid of the magnetic ink and jets it.

2. Related Art

A printer using ink jets the ink onto a paper through an ink jetting apparatus, forming an image. The ink jetted from the ink jetting apparatus is divided into water-soluble dye ink and magnetic pigment ink in a colloidal state. The dye ink is in a water-soluble state where dye is soluble in water such that, when it is jetted onto the paper, the water turns into vapor and only dye is left, forming an image. On the other hand, the pigment ink which is a magnetic ink exists in a colloidal state where liquid and pigment are mixed. The pigment ink in a colloidal state is easily controlled when it jets. Accordingly, it is currently widely used.

However, in the jetting of pigment ink, ink drops are not uniformly formed. That is, the ink drops are irregularly distributed in the liquid due to the colloidal state so that the mixture of the pigment and liquid is not uniform at each ink dot. This decreases clarity in printing and straightness of the drop.

The following patents are considered to be representative of the prior art relative to this invention, but are burdened by the disadvantages discussed herein: U.S. Pat. No. 5,677,717 to Ohashi entitled an *Ink Ejecting Device Having A Multilayer Protective Film For Electrodes,* U.S. Pat. No. 5,650,802 to Suzuki et al. entitled an *Ink Dispersion Device For Liquid Droplet Ejecting Apparatus,* U.S. Pat. No. 5,649,346 to Katsuumi et al. entitled a *Manufacturing Method For Ink Jet Printer Head,* U.S. Pat. No. 5,639,508 to Okawa et al. entitled a *Method For Producing A Layered Piezoelectric Element,* U.S. Pat. No. 5,570,119 to Saito et al. entitled a *Multilayer Device Having Integral Functional Element For Use With An Ink Jet Recording Apparatus, And Recording Apparatus,* U.S. Pat. No. 5,559,543 to Komuro entitled a *Method Of Making Uniformly Printing Ink Jet Recording Head,* U.S. Pat. No. 5,557,308 to Chandrasekaran entitled an *Ink Jet Print Head Photoresist Layer Having Durable Adhesion Characteristics,* U.S. Pat. No. 5,491,505 to Suzuki et al. entitled an *Ink Jet Recording Head And Apparatus Having A Protective Member Formed Above Energy Generators For Generating Energy Used To Discharge Ink,* U.S. Pat. No. 5,451,987 to Perrin entitled an *Ink Circuit Particularly Intended To Pressurize A Pigment Ink For An Ink Jet Printer,* U.S. Pat. No. 5,450,109 to Hock entitle a *Berrier Alignment And Process Monitor For TIJ Printheads,* U.S. Pat. No. 5,448,273 to Klein et al. entitled a *Thermal Ink Jet Printhead Protective Layers,* U.S. Pat. No. 5,440,333 to Sykora et al. entitled a *Collapsible Ink Reservoir And lnk-Jet Cartridge With Protective Bounding Layer For The Pressure Regulator,* U.S. Pat. No. 5,351,375 to Ochiai et al entitled a *Method For Fabricating Ink Jet Printhead,* U.S. Pat. No. 5,350,446 to Lin et al. entitled a *Hot Melt Impulse Ink Jet With Dispersed Solid Pigment In A Hot Melt Vehicle,* U.S. Pat. No. 5,278,584 to Keefe et al entitled an *lnk Delivery System For An Inkjet Printhead,* U.S. Pat. No. 5,243,363 to Koizumi et al entitled an *lnk-Jet Recording Head Having Bump-Shaped Electrode And Protective Layer Providing Structural Support,* U.S. Pat. No. 5,235,350 to Lin et al. entitled a *Pigmented semiconductive Hot melt Ink Jet Apparatus Employing Same,* U.S. Pat. No. 5,198,834 to Childers et al. entitled an *Ink Jet Print Head Having Two Cured Photoimaged Barrier Layers,* U.S. Pat. No. 5,187,500 to Bohorquez et al. entitled a *Control Of Energy To Thermal Inkjet Heating Elements,* U.S. Pat. No. 4,968,992 to Komuro entitled a *Method For Manufacturing A Liquid Jet Recording Head Having A Protective Layer Formed By Etching,* U.S. Pat. No. 4,845,517 to Tample et al. entitled a *Droplet Deposition Apparatus,* U.S. Pat. No. 4,803,501 to Mielke entitled a *Device For Generating Fluid Drops,* U.S. Pat. No. 4,633,267 to Meinhof entitled an *Arrangement For The Ejection Of Individual Droplets From Discharge Openings Of An Ink Printer Head,* U.S. Pat. No. 4,620,195 to Eblen et al. entitled a *Method Of Fabricating An Ink Droplet Generator For An Ink Jet Printer And Ink Droplet Generator Fabricated Thereby,* U.S. Pat. No. 4,544,933 to Heinzl entitled an *Apparatus And Method For Ink Droplet Ejection For A Printer,* U.S. Pat. No. 4,280,130 to Slemmons entitled *Forming Droplets For Ink Jet Printing,* U.S. Pat. No. 4,227,200 to Mansukhani entitled a *Pigmented Jet Printing And Product,* U.S. Pat. No. 4,196,437 to Hertz entitled a *Method And Apparatus For Forming A Compound Liquid Jet Particularly Suited For Ink-Jet Printing,* U.S. Pat. No. 4,078,238 to Lee entitled a *Magnetic Deflector For A Magnetic Ink Jet Printer,* U.S. Pat. No. 4,068,240 to Fan et al. entitled a *Vector Magnetic Ink Jet Printer With Stabilized Jet Stream,* U.S. Pat. No. 4,057,807 to Fischbeck et al. entitled a *Separable liquid Droplet Instrument And Magnetic Drivers Therefor,* U.S. Pat. No. 4,045,770 to Arnold et al. entitled a *Method And Apparatus For Adjusting The Velocity Of Ink Drops In An Ink Jet Printer,* and U.S. Pat. No. 4,027,308 to Fan et al. entitled a *Method And Apparatus For Forming Droplets.*

SUMMARY OF THE INVENTION

Accordingly, the present invention is directed to a magnetic ink jetting apparatus that substantially obviates one or more of the problems caused by limitations and disadvantages of the related art.

An object of the present invention is to provide a magnetic ink jetting apparatus which, when magnetic pigment ink is jetted, jets the ink with a uniform mixture ratio with respect to pigment and liquid.

Another object of the present invention is to provide a magnetic ink jetting apparatus which jets ink onto a paper, uniformly mixing its liquid and pigment by unit volume, and improving printing quality.

To achieve these and other advantages and in accordance with the purpose of the present invention, as embodied and broadly described, the magnetic ink jetting apparatus for jetting the magnetic ink with uniform mixture of its pigment and liquid includes a plurality of ink chamber barriers for forming an ink chamber for receiving the magnetic ink, and a magnetic layer for creating magnetism in the ink chamber so as to concentrate the pigment of the magnetic ink, the magnetic layer being formed between the plurality of ink chamber barriers.

It is to be understood that both the foregoing general description and the following detailed description are exemplary and explanatory, and are intended to provide further explanation of the invention as claimed.

BRIEF DESCRIPTION OF THE DRAWINGS

A more complete appreciation of the invention, and many of the attendant advantages thereof will be readily apparent as the same becomes better understood by reference to the following detailed description when considered in conjunction with the accompanying drawings in which like reference symbols indicate the same or similar components, wherein.

DETAILED DESCRIPTION OF PREFERRED EMBODIMENT

Reference will now be made in detail to the preferred embodiments of the present invention, examples of which are illustrated in the accompanying drawings.

Figure 1:
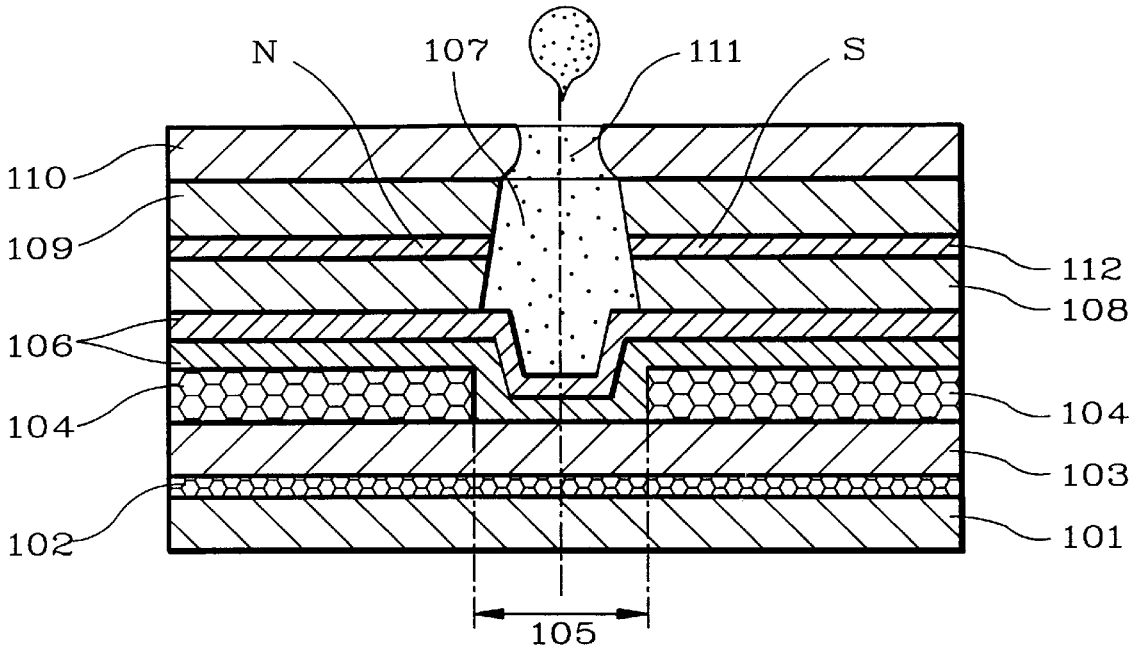
FIG. 1 is a cross-sectional view of a magnetic ink jetting apparatus according to the present invention.

FIG. 1 is a cross-sectional view of a magnetic ink jetting apparatus according to the present invention. Referring to FIG. 1, the magnetic ink jetting apparatus according to the invention includes: a substrate 101 formed from, for example, Silicon (Si); a protection layer 102 for protecting the surface of substrate 101; a resist or resistance layer 103 formed on protection layer 102 and forming a heating portion 105 generating thermal energy; a plurality of electrode layers 104 for providing resist or resistance layer 103 with electric energy; a plurality of protection layers 106 formed on electrode layers 104 for transmitting the thermal energy generated from heating portion 105 formed in resist or resistance layer 103; a plurality of ink chamber barriers 108 and 109 formed on the plurality of protection layers 106 for forming an ink chamber 107 receiving magnetic pigment ink; a magnetic layer 112 formed between the plurality of ink chamber barriers 108 and 109 for creating magnetism (N,S) in ink chamber 107 so as to concentrate the pigment of the ink; and an opening portion 110 for forming an opening or nozzle 111 aligned with the plurality of ink chamber barriers 108 and 109.

Figure 2:
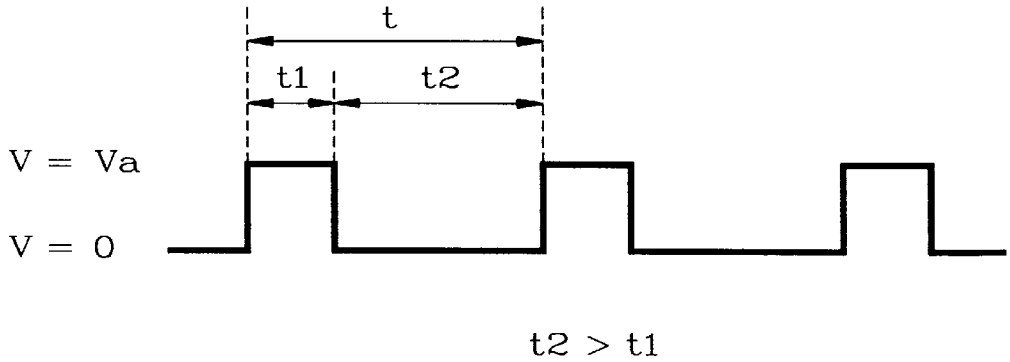
FIG. 2 is a waveform diagram showing a cycle of electric energy applied to the magnetic ink jetting apparatus shown in FIG. 1.

The ink jetting operation of the magnetic ink jetting apparatus constructed as above is explained below. There will be described an ink jetting structure wherein one of multiple nozzles of the magnetic ink jetting apparatus jets ink as an example. The plurality of electrode layers 104 receives electric energy with a waveform having a cycle (t), as shown in FIG. 2. The electric energy is activated during a time interval (t1) of cycle (t). When the electric energy corresponding to interval (t1) is applied to the plurality of electrode layers 104, heating portion 105 formed in resist or resistance layer 103 generates thermal energy in proportion to the electric energy. At this time, the temperature of heat created from heating portion 105 is 500° C. to 550° C. The thermal energy generated from heating portion 105 is transmitted to the plurality of protection layers 106 which transfer the thermal energy and prevent the plurality of electrode layers 104 from being corroded by liquid serving as the carrier of the pigment ink.

Figure 3:
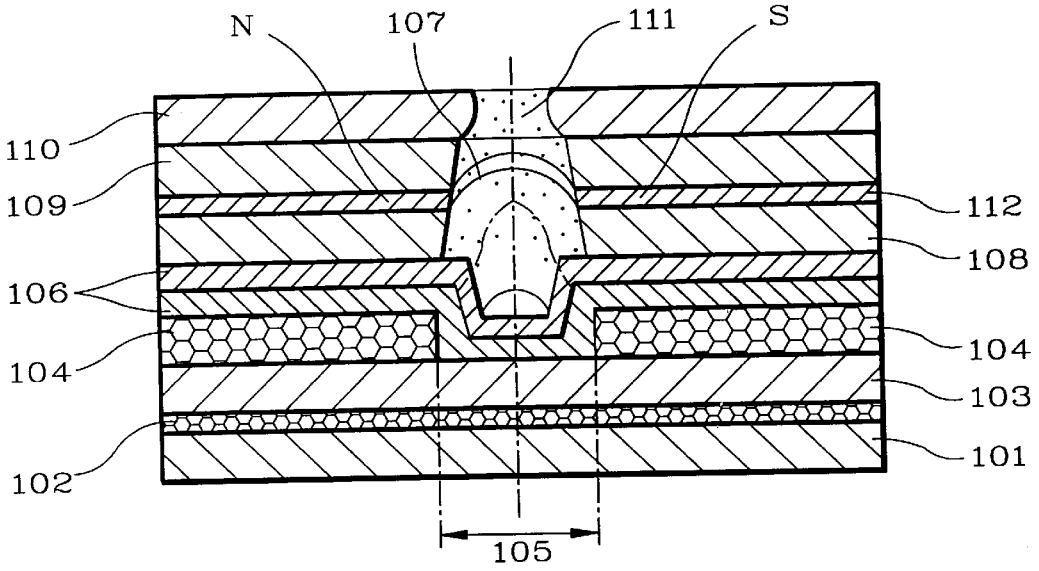
FIGS. 3 and 4 are cross-sectional views showing an ink jetting state in the magnetic ink jetting apparatus shown in FIG. 1.
Figure 4:
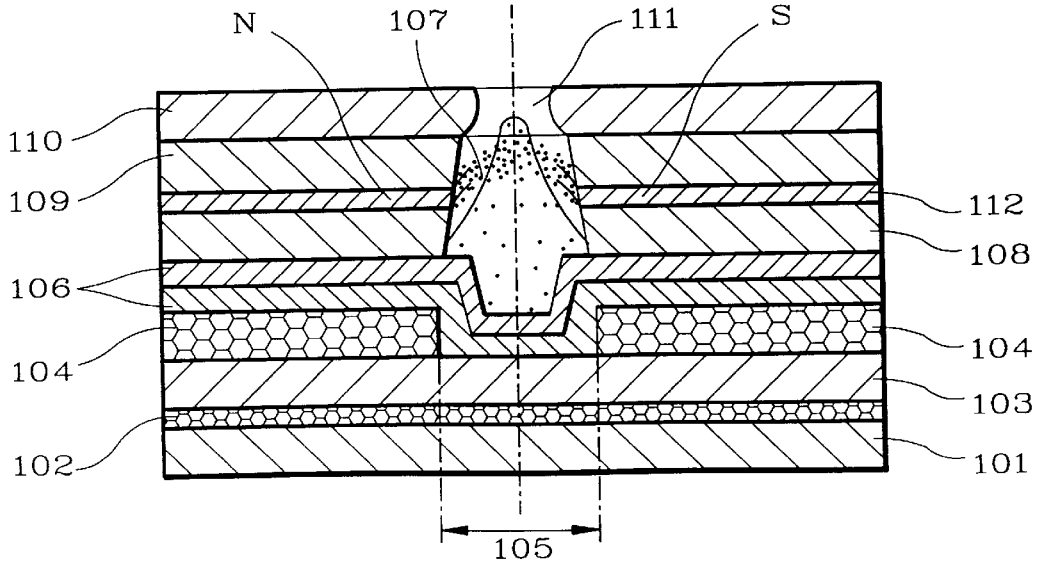

The plurality of protection layers 106 are heated by the thermal energy received from heating portion 105. Accordingly, the liquid of pigment ink supplied to ink chamber 107 through an ink channel formed in second ink chamber barrier 109 forms a vapor pressure, as shown in FIG. 3. At the same time, the pigment of the ink is concentrated on magnetic layer 112 due to its magnetism (N, S). The pigment having magnetism is concentrated in the center of a magnetic area formed between negative pole and positive pole of magnetic layer 112. At this stage, when the vapor pressure of the liquid in ink chamber 107 increases, the liquid passes the pigment concentrated between the negative pole and positive pole of magnetic layer 112 according to the vapor pressure, as shown in FIG. 4. In this process, a specific amount of pigment can be contained in the liquid.

When the vapor pressure of the liquid generated by the thermal energy of heating portion 105 causes the pigment to be contained in the liquid, the operation corresponding to time interval (t2) of the waveform of FIG. 2 is carried out. During interval (t2), when the electric energy applied to the plurality of electrode layers 104 is cut off, heating portion 105 is cooled. Accordingly, an ink drop is generated in opening 111 formed in opening portion 110 according to the surface tension of the pigment ink, as shown in FIG. 1. As a result, the ink can be jetted and has uniform volume of pigment particles and liquid per drop.

Figure 5:
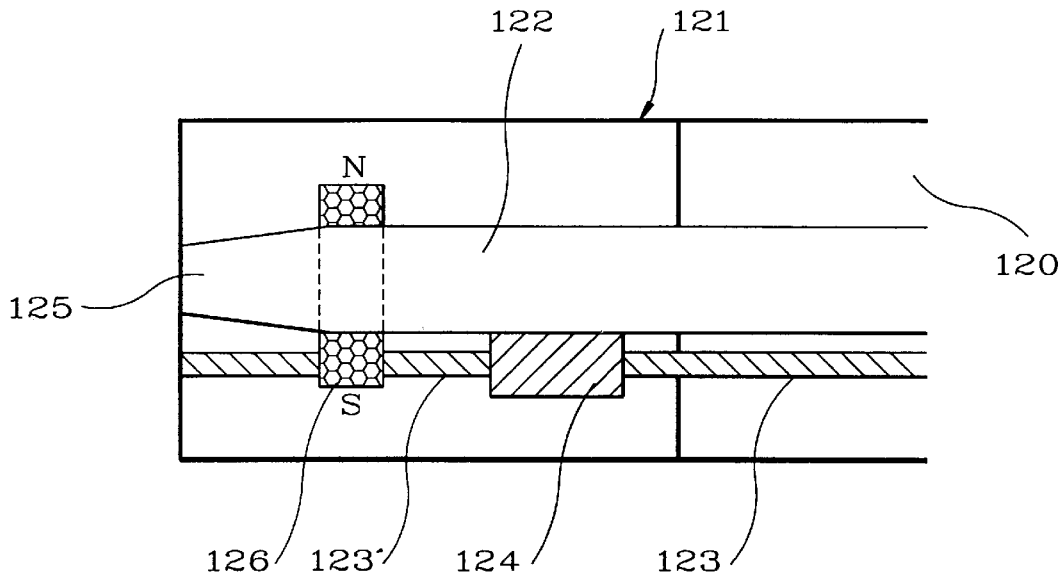
FIG. 5 is a cross-sectional view of a magnetic ink jetting apparatus according to an embodiment of the present invention.

There will be described an embodiment of magnetic ink jetting apparatus which jets the magnetic pigment ink, maintaining the ratio of the amount of pigment and liquid. As shown in FIG. 5, the magnetic ink jetting apparatus according to an embodiment of the present invention includes: a nozzle 121 forming an opening 125; a channel 120 providing nozzle 121 with magnetic pigment ink; a magnetic layer 126 formed adjacent to opening 125 of nozzle 121 for generating magnetism and concentrating the pigment of the ink supplied to channel 120; a heating portion 124 formed on one side of nozzle 121 for heating or cooling the liquid of the pigment ink supplied through channel 120 so as to form an ink drop containing the pigment concentrated by magnetic layer 126; and a plurality of electrode layers 123 and 123' for providing heating portion 124 with electric energy.

Figure 6:
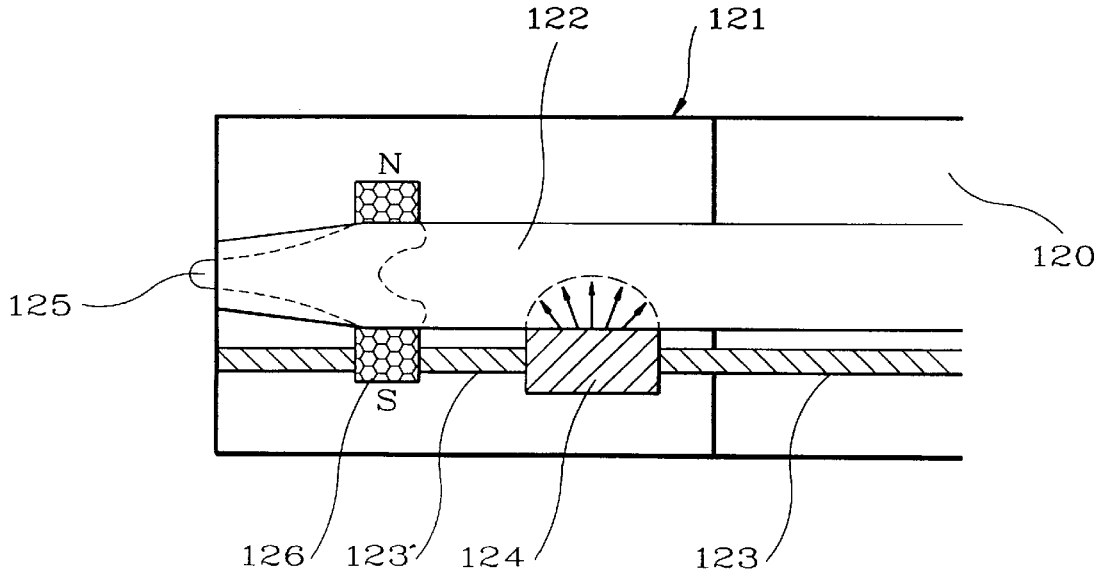
FIGS. 6, 7 and 8 are cross-sectional views showing ink jetting states in the magnetic ink jetting apparatus shown in FIG. 5.
Figure 7:
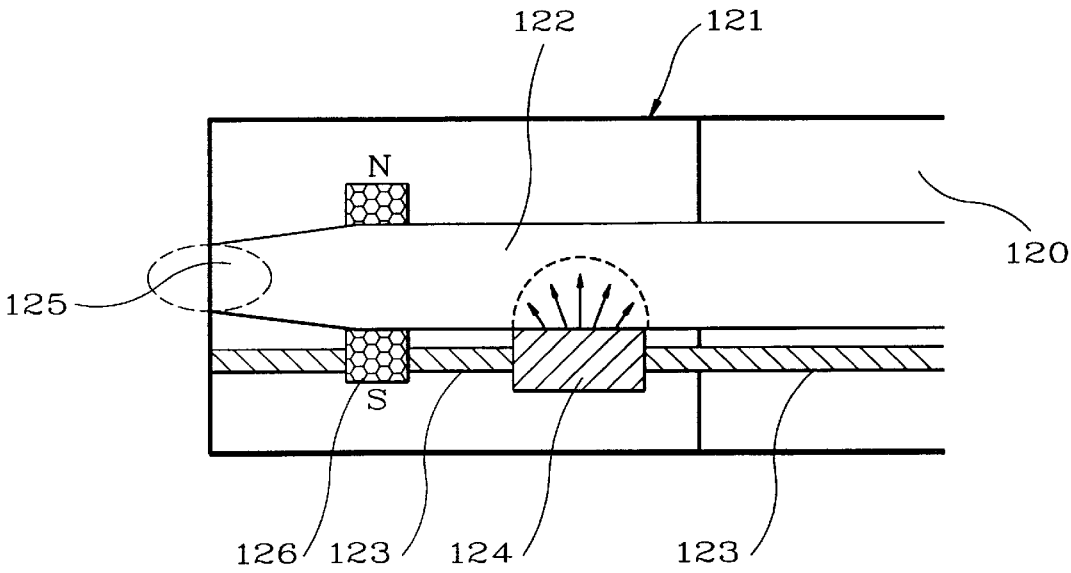
Figure 8:
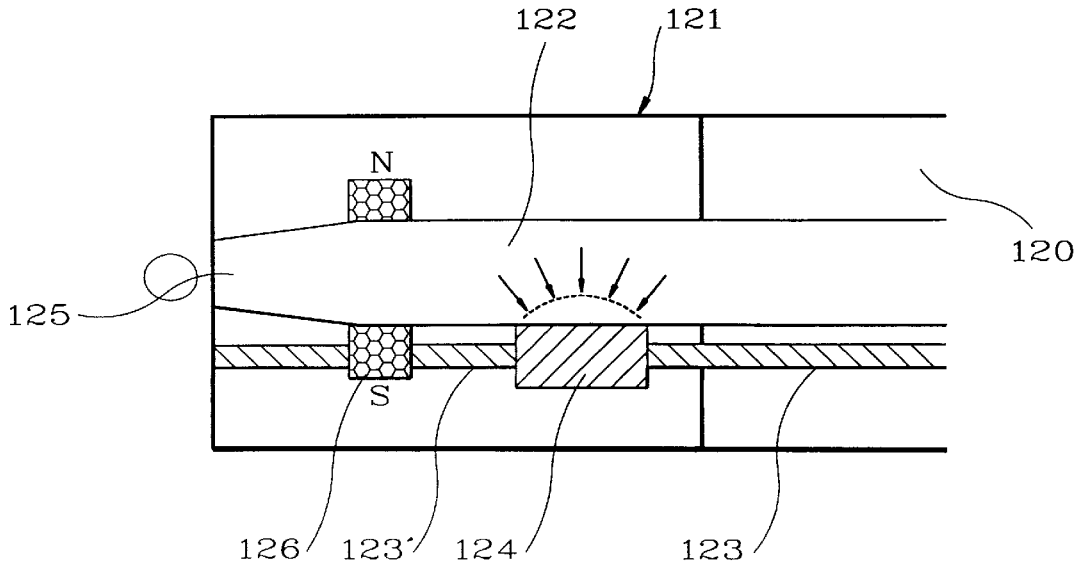

The magnetic ink jetting operation in the magnetic ink jetting apparatus constructed as above is explained below. Referring to FIG. 6, the magnetic pigment ink is supplied through channel 120, and is heated by heating portion 124 which receives electric energy through the plurality of electrode layers 123 and 123'. The liquid of the pigment ink, heated by heating portion 124, generates vapor pressure in the form of spikes. This vapor pressure pushes the magnetic pigment ink toward opening 125. In this state, when electric energy is continuously applied to heating portion 124, the vapor pressure increases. If the electric energy applied to electrode layers 123 and 123' is cut off at a certain point, heating portion 124 is cooled at that point. This generates an oval drop around opening 125, as seen in FIG. 7, according to the surface tension of the liquid and pigment having magnetism concentrated by magnetic layer 126. Here, magnetic layer 126 is constructed of multiple magnetic substances and is divided into negative pole and positive pole. In this state, when heating portion 124 is continuously cooled, the oval drop comes out of opening 125 due to the power of vapor pressure, as shown in FIG. 8, so as to be jetted and forming a round-shape drop. That is, while the pigment having magnetism is concentrated using magnetic layer 126, the ink is jetted, and has a uniform mixture ratio of pigment and liquid in accordance with the vapor pressure of the liquid due to thermal energy of heating portion 124.

As described above, the magnetic ink jetting apparatus of the present invention forms an ink drop having a uniform ratio of pigment and liquid from the magnetic pigment ink and jets it, while improving straightness of the drop and clarity of printing.

It will be apparent to those skilled in the art that various modifications and variations can be made in the magnetic ink jetting apparatus of the present invention without departing from the spirit or scope of the invention. Thus, it is intended that the present invention cover the modifications and variations of this invention provided they come within the scope of the appended claims and their equivalents.

What is claimed is:

1. A magnetic ink jetting apparatus for jetting magnetic ink with a uniform mixture of pigment and liquid, said apparatus comprising:

a nozzle plate having a nozzle;

a first ink chamber barrier disposed adjacent to said nozzle plate having said nozzle, wherein said first ink chamber barrier defines an ink chamber and said nozzle is disposed at one end of said ink chamber;

a magnetic layer creating magnetism in the ink chamber so as to concentrate the pigment of the magnetic ink, wherein the magnetic layer is disposed on a side of said first ink chamber barrier opposite from a side adjacent to said nozzle plate; and a second ink chamber barrier disposed adjacent said magnetic layer on a side opposite that of said first ink chamber barrier wherein said second ink chamber barrier defines said ink chamber and said second ink chamber barrier is formed on a plurality of protection layers formed at another end of said ink chamber.

2. The magnetic ink jetting apparatus as claimed in claim 1, further comprising an electrode layer on which said plurality of protection layers is disposed.

3. The magnetic ink jetting apparatus as claimed in claim 2, wherein said electrode layer comprises first and second electrode layer portions, said apparatus further comprising a heating portion disposed between said first and second electrode layer portions.

4. The magnetic ink jetting apparatus as claimed in claim 2, further comprising a resistance layer on which said electrode layer is disposed.

5. The magnetic ink jetting apparatus as claimed in claim 4, further comprising a heating portion formed in said resistance layer.

6. The magnetic ink jetting apparatus as claimed in claim 5, further comprising an additional protection layer on which said resistance layer is disposed.

7. The magnetic ink jetting apparatus as claimed in claim 6, further comprising a heating portion formed in said resistance layer.

8. The magnetic ink jetting apparatus as claimed in claim 6, further comprising a substrate on which said additional protection layer is disposed.

9. The magnetic ink jetting apparatus as claimed in claim 8, further comprising a heating portion formed within said resistance layer.

10. The magnetic ink jetting apparatus as claimed in claim 1, further comprising a resistance layer above which said plurality of protection layers is disposed.

11. The magnetic ink jetting apparatus as claimed in claim 10, further comprising a heating portion formed in said resistance layer.

12. The magnetic ink jetting apparatus as claimed in claim 10, further comprising an additional protection layer on which said resistance layer is disposed.

13. The magnetic ink jetting apparatus as claimed in claim 12, further comprising a heating portion formed in said resistance layer.

14. The magnetic ink jetting apparatus as claimed in claim 12, further comprising a substrate on which said additional protection layer is disposed.

15. The magnetic ink jetting apparatus as claimed in claim 14, further comprising a heating portion formed in said resistance layer.

16. The magnetic ink jetting apparatus as claimed in claim 1, further comprising an additional protection layer above which said plurality of protection layers is disposed.

17. The magnetic ink jetting apparatus as claimed in claim 16, further comprising a heating portion formed above said additional protection layer.

18. The magnetic ink jetting apparatus as claimed in claim 16, further comprising a substrate on which said additional protection layer is disposed.

19. The magnetic ink jetting apparatus as claimed in claim 18, further comprising a heating portion formed above said additional protection layer.

20. The magnetic ink jetting apparatus as claimed in claim 1, wherein the magnetic layer includes a negative pole and a positive pole.

21. A magnetic ink jetting apparatus for jetting magnetic ink with a uniform mixture of pigment and liquid, said apparatus comprising:

a nozzle plate having a nozzle;

a first ink chamber barrier disposed adjacent to said nozzle plate having said nozzle, wherein said first ink chamber barrier defines an ink chamber and said nozzle is disposed at one end of said ink chamber;

a magnetic layer generating magnetism so as to concentrate the pigment of the magnetic ink supplied through a channel, wherein the magnetic layer is disposed on a side of said first ink chamber barrier opposite form a side which is adjacent to said nozzle plate:

a second ink chamber barrier disposed adjacent said magnetic layer on a side opposite that of said first ink chamber barrier, wherein said second ink chamber barrier defines said ink chamber: and a heating portion which heats the magnetic ink supplied through the channel so as to form a drop uniformly containing the pigment concentrated by the magnetic layer wherein said heating portion is formed at an end of the ink chamber opposite that of said nozzle.

22. The magnetic ink jetting apparatus as claimed in claim 21, further comprising at least one electrode layer connected to said heating portion for providing electrical energy thereto.

23. A magnetic ink jetting method for jetting ink with a uniform mixture of pigment and liquid, said method comprising the steps of:

providing a nozzle plate having a nozzle formed therein;

forming a first ink chamber barrier adjacent to said nozzle plate wherein said first ink chamber barrier defines an ink chamber and said nozzle is disposed at one end of said ink chamber;

providing a channel for supplying the magnetic ink to said ink chamber;

forming a magnetic layer generating magnetism so as to concentrate the pigment of the magnetic ink, wherein the magnetic layer is disposed on a side of said first ink chamber barrier opposite from a side adjacent to said nozzle plate;

a second ink chamber barrier disposed adjacent said magnetic layer on a side opposite that of said first ink chamber barrier, wherein said second ink chamber barrier defines said ink chamber; and heating the magnetic ink supplied by the channel, so as to form a drop uniformly containing the pigment concentrated by the magnetic ink and to eject the drop.

24. The method as claimed in claim 23, wherein the heating of the liquid of the magnetic ink generates vapor pressure which pushes the magnetic pigment ink toward the opening.

25. The method as claimed in claim 23, further comprising continuously applying electric energy to heat the liquid of the magnetic ink, whereby increasing vapor pressure is generated so as to push the magnetic pigment ink toward said opening.

26. The method as claimed in claim 23, further comprising a step of providing electrode layers for providing electric energy to heat the liquid of the pigment ink.

27. The method as claimed in claim 26, wherein said cooling step comprises cutting off electric energy applied to said electrode layers so as to cool the liquid of the pigment ink, thereby generating and oval drop around said opening in accordance with a surface tension of the liquid and pigment having magnetism concentrated by the magnetic layer.

28. The method as claimed in claim 27, further comprising the step of continuing to cool the liquid of the pigment ink, whereby the oval drop emerges from said opening due to vapor pressure and is jetted in the form of a round-shaped drop.

* * * * *